US006945175B1

(12) United States Patent
Gotzmer et al.

(10) Patent No.: US 6,945,175 B1
(45) Date of Patent: Sep. 20, 2005

(54) BIOLOGICAL AND CHEMICAL AGENT DEFEAT SYSTEM

(75) Inventors: Carl Gotzmer, Accokeek, MD (US); Joe Mayersak, Asburn, VA (US); Steven S. Kim, Crofton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 117 days.

(21) Appl. No.: 10/463,882

(22) Filed: Jun. 18, 2003

(51) Int. Cl.[7] ..... F42B 12/44

(52) U.S. Cl. ..... 102/364; 102/519; 102/489; 86/50

(58) Field of Search ..... 102/519, 364, 102/489, 517, 365, 403, 473, 477, 478, 501, 102/518; 86/50; 149/124; 89/1.11, 1.1, 1.13

(56) References Cited

U.S. PATENT DOCUMENTS

| | | | | |
|---|---|---|---|---|
| 3,302,570 | A * | 2/1967 | Marquardt | 102/364 |
| 3,797,391 | A * | 3/1974 | Cammarata et al. | 102/364 |
| 3,981,243 | A * | 9/1976 | Doris, Jr. | 102/364 |
| 4,318,343 | A * | 3/1982 | King | 102/365 |
| 4,967,666 | A | 11/1990 | Kellner et al. | 102/476 |
| 5,526,752 | A | 6/1996 | Dahl et al. | 102/517 |
| 5,780,766 | A | 7/1998 | Schroppel | 102/372 |
| 5,939,662 | A | 8/1999 | Bootes et al. | 102/473 |
| 6,011,193 | A | 1/2000 | Myler et al. | 588/200 |
| 6,105,505 | A * | 8/2000 | Jones | 102/364 |
| 6,308,607 | B1 * | 10/2001 | Woodall et al. | 89/1.13 |
| 6,354,181 | B1 | 3/2002 | Donovan | 86/50 |
| 6,382,105 | B1 * | 5/2002 | Jones | 102/370 |
| 6,679,176 | B1 * | 1/2004 | Zavitsanos et al. | 102/364 |
| 6,691,622 | B2 * | 2/2004 | Zavitsanos et al. | 102/364 |
| 2003/0034102 | A1 * | 2/2003 | Thiesen et al. | 149/19.6 |

* cited by examiner

*Primary Examiner*—Michael J. Carone
*Assistant Examiner*—James S. Bergin
(74) *Attorney, Agent, or Firm*—Fredric J. Zimmerman

(57) ABSTRACT

The present invention comprises a kinetic energy penetrator warhead that may engage both surface and buried soft and hardened targets. The warhead contains a high-temperature incendiary (HTI) fill capable of destroying chemical and biological agents in such a manner to minimize dispersal of these agents. Bomblets are incorporated into the portion of the warhead that penetrates to the target and are ejected, with the HTI fill, from the warhead in order to provide holes in chemical or biological agent tanks to allow the fill to react with said agents. Finally, a guidance system is provided to direct the warhead to the target.

36 Claims, 5 Drawing Sheets

BIOLOGICAL AND CHEMICAL AGENT DEFEAT SYSTEM

STATEMENT OF GOVERNMENT INTEREST

The invention described herein was developed jointly by the inventors, at least one inventor being an employee of the United States Government, and as such, the United States Government has certain rights in the invention.

BACKGROUND OF THE INVENTION

1. Field of the Invention

The present invention pertains to weapon systems, more particularly to weapon systems that can penetrate and destroy targets associated with weapons of mass destruction including manufacturing and storage facilities, and most particularly to weapon systems that can penetrate and destroy chemical and biological manufacturing and storage facilities and warhead and weapons storage and bunker facilities without dispersing chemical and biological agents that could result in severe collateral damage.

2. Description of the Related Art

Weapon systems have been designed to effectively destroy myriad types of targets. Most of these systems have been designed with two criteria in mind. First, the weapon system must be able to reach the target. Second, the weapon system must then be able to destroy the target. However, in dealing with targets that contain chemical or biological agents, such as chemical and biological manufacturing and storage facilities, a third criteria must also be addressed. These chemical and biological agents must be destroyed in such a manner to preclude or minimize the release of the chemical and biological agents outside the facility to minimize dispersal of these agents to avoid severe collateral damage.

While many current chemical and biological manufacturing and storage facilities are located above ground, in the future these facilities could well be relocated to buried, fortified locations that are more difficult to reach or may not be reachable by conventional weapons systems due to their deeply buried hardened construction. Many weapon system concepts have been developed to address providing the means to enable a destructive payload to be delivered to these hardened deeply buried targets and other difficult to reach such targets. For example, U.S. Pat. No. 4,967,666 discloses a warhead that uses a forward hollow charge in order to create a passageway for an internal, follow-up projectile to be fired into fortified or armored targets. U.S. Pat. No. 5,780,766 discloses a similar type of "two-stage" device comprising an armor piercing hollow charge that clears a region or path for the missile to reach its final destination, where upon impact, a post-firing fragmentation explosive charge is released due to inertia. U.S. Pat. No. 5,526,752 discloses a projectile that includes multiple warheads separated by casing with independent detonators wherein the warheads are detonated sequentially in order to penetrate the target. U.S. Pat. No. 5,939,662 discloses a missile warhead comprising a tungsten ballast to provide high warhead cross sectional density to increase pressure upon impact. Finally, U.S. Pat. No. 6,283,036 discloses a variable output warhead comprising several compartments separated by a shock-absorbing shield, each filled with explosive material wherein the shield prevents sympathetic detonation from one compartment to another. Depending upon the target, a specific number of compartments can be selected for initiation.

While these and other designs have provided some success in attacking hardened and deeply buried targets, none of these weapon systems addresses the need to destroy the final target in such a manner to minimize dispersal of chemical and biological agents as noted above. There have been systems designed to safely destroy chemical and biological agents. U.S. Pat. No. 6,011,193 describes a method to destroy chemical weapons by acid digestion. U.S. Pat. No. 6,354,181 describes a method and apparatus to destroy terrorist weapons by detonation of these weapons in a contained environment. However, these and other known methods were developed to destroy chemical and biological agents that are in the users' control and in some type of controlled and contained environment.

Therefore, it is desired to provide a weapon system that can penetrate both surface targets or soft targets and deeply buried hardened targets or hard targets containing chemical and biological agents and destroy these agents in such a manner to minimize dispersal of these agents to avoid severe collateral damage.

SUMMARY OF THE INVENTION

The present invention comprises a weapon system that is capable of engaging both surface and buried targets that contain chemical and biological agents. It can also be used to engaged surface and buried targets which are sensitive to incendiary devices such as petroleum and fuel storage facilities, conventional weapons bunkers containing high explosive and blast fragmentation weapons and other targets. In engaging chemical and biological manufacturing and storage facilities the system then destroys the chemical and biological agents in such a manner to minimize dispersal of these agents to ensure that collateral damage is also minimized.

Accordingly, it is an object of this invention to provide a weapon system that may engage surface and buried targets.

It is a further object of this invention to provide a weapon system that can defeat chemical and biological agents.

A still further object of this invention is to provide a weapons system that minimizes the dispersal of chemical and biological agents that it destroys.

A still further object of this invention is to provide a weapon system that can be used to engage refineries, petroleum and oil storage facilities, weapons bunkers and other targets which are sensitive to high temperature incendiary effects.

This invention accomplishes these objectives and other needs related to weapon systems by providing a kinetic energy penetrator warhead that may engage both surface and buried soft and hardened targets. The warhead contains a high-temperature incendiary (HTI) fill capable of destroying chemical and biological agents in such a manner to minimize dispersal of these agents. Bomblets are incorporated into the warhead and are ejected, with the HTI fill, from the warhead in order to provide the means to open the chemical and biological agent containers and tanks to provide access to the chemical and biological agent to allow the product of the reaction of the warhead fill to react with and destroy said agents. Finally, a guidance system is provided to direct the warhead to the target.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a weapon system for destroying chemical and biological agents within a structure. The invention is designed to minimize collateral damage resulting from the destruction of these agents. The system includes a kinetic energy penetrator warhead using a precision guidance system. The fill within the warhead is a two-stage intermetallic high-temperature incendiary composition that heats the target environment to high temperature through convective and radient heat transfer. The reaction of the two stage fill also generates a biocide as a product of the reaction in order to defeat chemical and biological agents with minimum dispersal and escape of said agents from the target. The payload of the warhead also includes a plurality of bomblets that are capable of penetrating tanks, containers, and other enclosures that hold chemical and biological agents, so that the high temperature reactants of the fill, including the biocide, can react with said agents. The system also includes a separation system that separates the tail section of the warhead from the payload section of the warhead to allow the bomblets and fill to be expelled from the system. Finally, the invention includes an expulsion system that expels the bomblets in order to penetrate tanks, containers, etc. and the fill in order to react with and destroy the chemical and biological agents.

Figure 1:
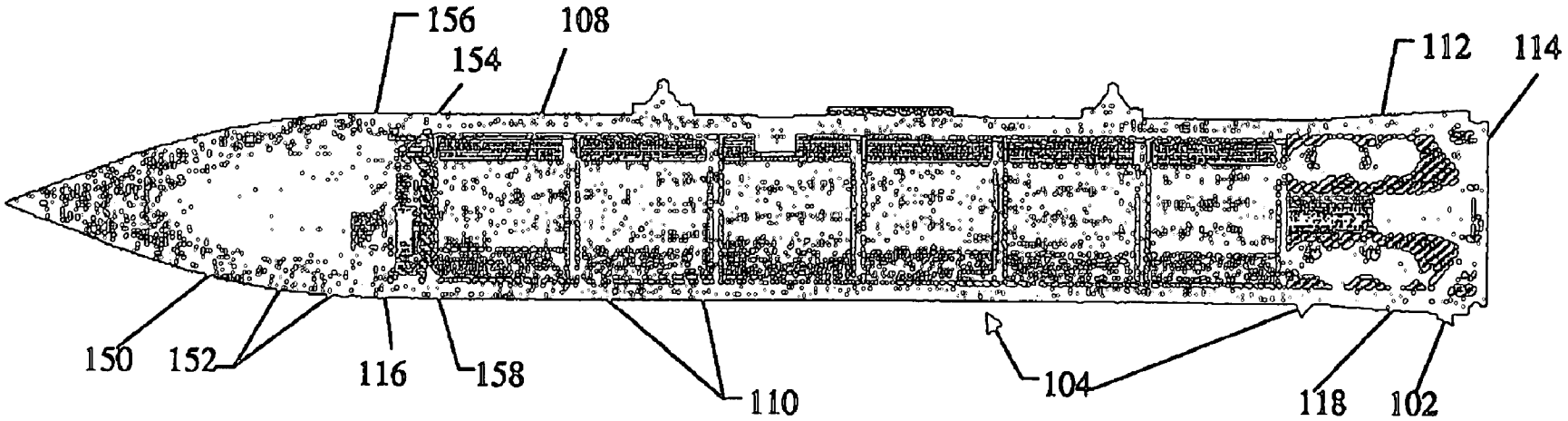
FIG. 1 is a side view of an embodiment of the present invention.
Figure 2:
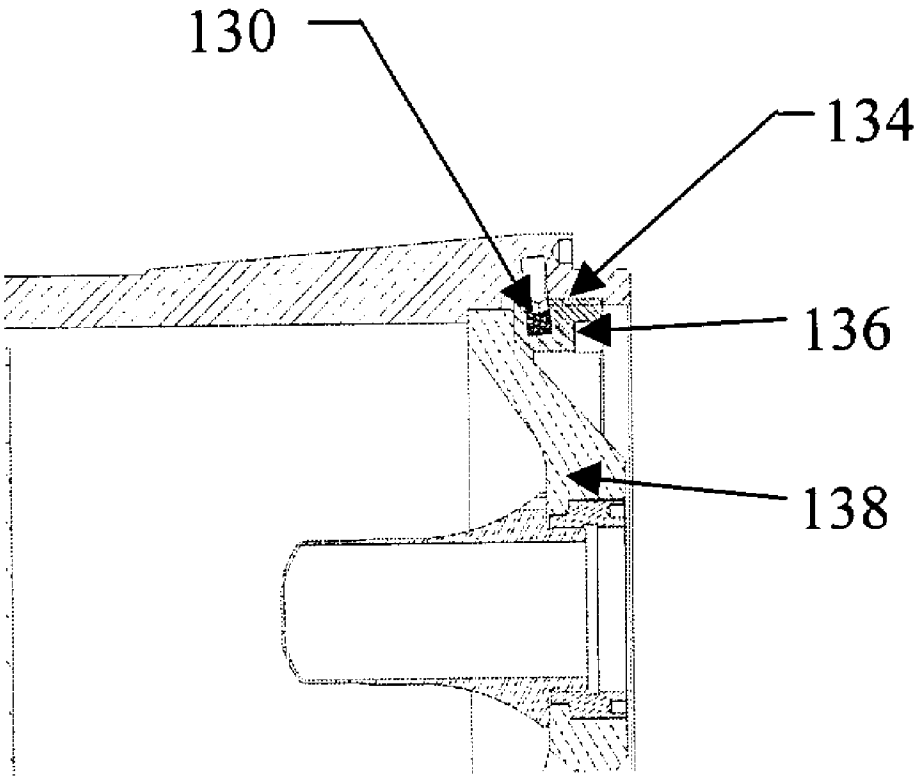
FIG. 2 is an expanded cut-away view of the separation system of an embodiment of the invention.
Figure 3:
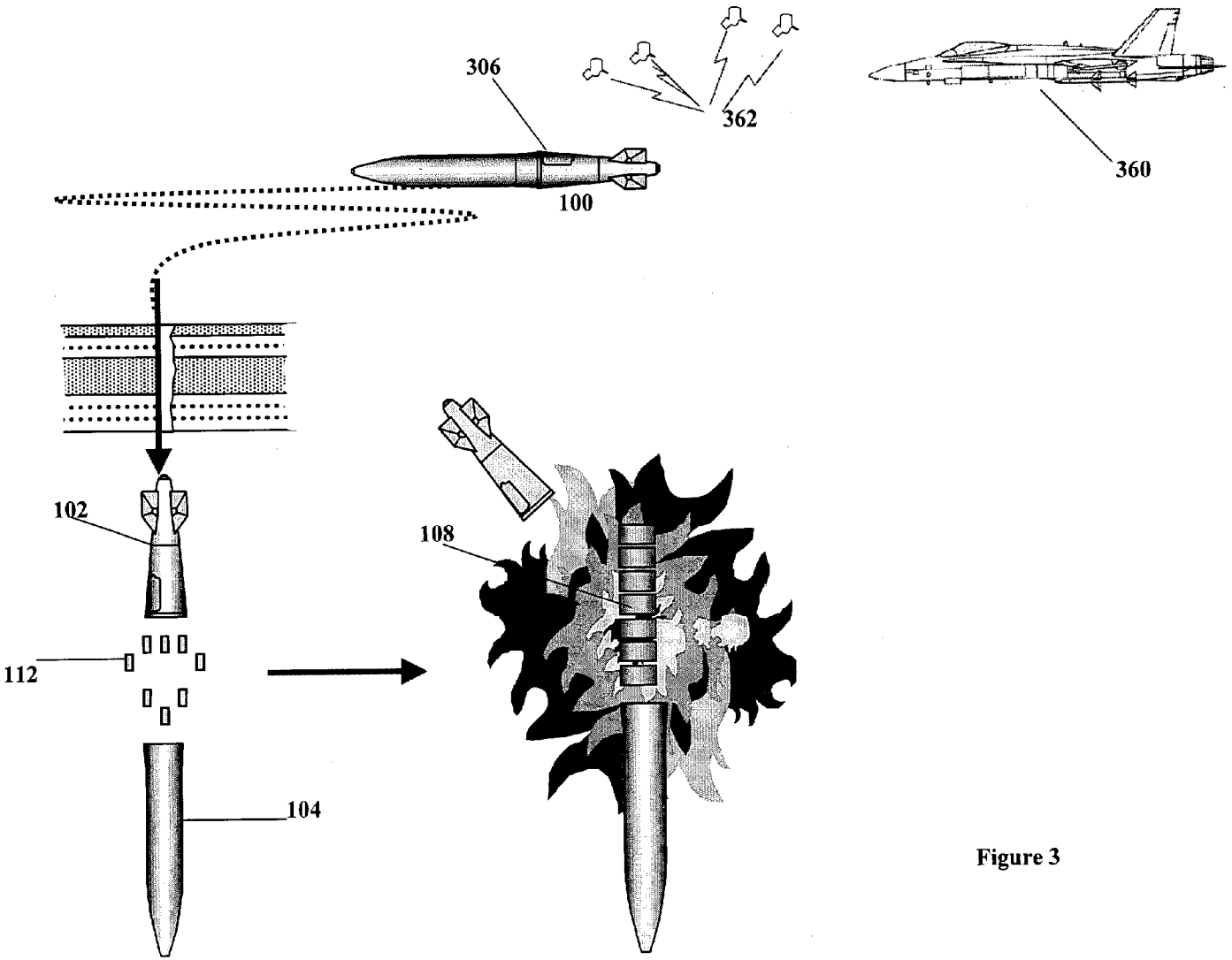
FIG. 3 shows the embodiment of the invention of FIG. 1 in operation.

Referring to FIGS. 1–3, the invention comprises a kinetic energy penetrator warhead 100 having a tail section 102 and a payload section 104. A guidance system 306 is incorporated into the warhead 100. A separation system 114, capable of separating the tail section 102 from the payload section 104, is placed proximate to the transition between the tail section 102 and the payload section 104. A high-temperature incendiary fill 108 is located within the payload section 104. In the embodiment shown in FIG. 2, the high-temperature incendiary fill is placed within a plurality of cartridges 110. A plurality of bomblets 112 are also placed within the payload section 104. Preferably, the plurality of bomblets 112 are placed between the cartridges 110 and the separation system 114. A biocide agent 118 is placed behind the plurality of bomblets 112. Finally, an expulsion system 116 is located within the payload system that ejects the plurality of bomblets 112 and the high-temperature incendiary fill 108 in such a manner so that the plurality of bomblets 112 may penetrate tanks containing chemical or biological agents allowing the high-temperature incendiary fill 108 to react with the chemical and biological agents to destroy and minimize dispersal of said agents.

Kinetic energy penetrator warhead systems 100 are known in the art and preferable embodiments for the present application may be selected by one skilled in the art. One preferred kinetic energy penetrator warhead 100 is the 2000 pound BLU-109 penetrator. Another preferred kinetic energy penetrator warhead 100 is the 1000 pound J-1000 warhead. However, depending upon the target, various warheads could be used.

There are many warhead guidance systems 306 and one may selected by those skilled in the art as long as it is capable of guiding the warhead to the target. One preferred guidance system 306 comprises a Joint Direct Attack Munition (JDAM) guidance kit which is located. The JDAM employs a GPS updated inertial guidance 362 concept to effect guidance to the target coupled with a movable tail control kit, for aeerodynamic control, which retrofits to the existing bomb inventory including, but not limited to, Mk-84, 82 and 80 series bombs and BLU-109 bombs. Another guidance system 306 example is the semi-active laser guidance system which is used in the Guided Bomb Unit-24. In use, this system illuminates the target with a laser beam and the weapon guidance kit interprets the refelction of the laser energy from the target in such a way to provide steering commands to the canards on the nose of the bomb to effect aerodynamic control to steel to bomb to the target.

Figure 5:
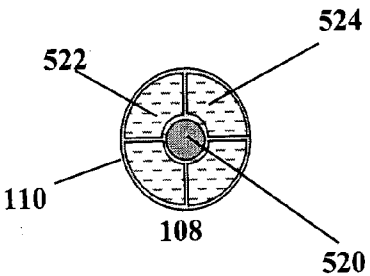
FIG. 5 shows a cut-away view of an embodiment of a high-temperature incendiary fill cartridge.

The high-temperature incendiary fill 108, through reaction, produces convective heating, thermal radiation, and a biocide in order to defeat both chemical and biological agents while minimizing dispersal of these agents. The high-temperature incendiary fill 108 preferably comprises either a single stage intermetallic composition that generates heat or a two stage intermetallic reaction where the first stage is a single stage intermeatllic reaction when the intermetallic reacts with an oxidize, such as lithium perchlorate or sodium chlorate, which provides oxygen, to generate oxides of the intermetallic constituents with additon heat release. These intermetallic compositions generate a thermal impulse having a maximum temperature from about 750 to 1500 degrees Fahrenheit, depending upon the size of the target engaged, in order to destroy the agent due to high heat, destroying the agent due to exceeding its normal temperature range in which it can exist, and due to agent combustion. This results from a two-stage reaction that creates over 6,200 calories per cubic centimeter of reactants. In turn, the reaction's adiabatic flame temperature is of the order of 6500 to 7000 degrees Fahrenheit. The thermal impulse should also maintain a high-temperature for as long as possible in order to ensure that the chemical and biological agents are destroyed by raising the temperature of the agent outside the bounds at which temperature it can survive, upsetting and disrupting metabolism functions in the agent critical to its existance and well being and combustion of the agent where the agent undergoes oxidization in a combusion process. A preferred thermal profile should include a thermal impulse burning rate of over 400 degrees Fahrenheit for several minutes, and preferably over five minutes. The intermetallic composition will preferably contain an oxidizer that generates a biocide during the reaction such as halogenated compounds including chlorine, fluorine, or their acid derivatives. The intermetallic composition also preferably contains a large number of wicking fibers in the fill. The purpose of the wicking fibers is to "wick" up chemical and biological agent and to present a local ignition site to ignite the chemical agent, by the burning fill, much like lighting a candle wick, and to initiate and maintain the burning of the agent in pool fires. The selection of the intermetallic fill and the second stage oxidizer and the binder in both the first stage and second stage fill should be made, preferably, so that the products of the reaction will include a biocide such as chlorine, iodine or fluorine. Finally, the intermetallic composition should achieve the thermal impulse discussed above with low-overpressure, normally in the range of 0.2 to 0.5 psi, in order to ensure minimal dispersion of the chemical and biological agents during defeat. FIG. 5 shows one preferred high-temperature incendiary fill 108 in a cartridge 110 case cross-view. The intermetallic center 520 is made up of titanium and boron. The surrounding oxidizer 522, preferably lithium perchlorate or sodium chlorate, and most preferably lithium perchlorate, contains wicking fibers 524. The selection of a perchlorate for the surrounding oxidizer enables the generation of chlorine, which is a biocide, as one of the products of reaction. In addition, certain metal chlorides can be added in the oxidizer to act as additional sources of chlorine. A binder will generally be included in the composition. One example is a polyfluoro binder. This binder, in its participation in the reaction, would provide fluorine as a product of the reaction which, as previously mentioned, is a biocide. The first step of the reaction, the titanium and boron ignite to form titanium diboride. This, in turn, reacts with the lithium perchlorate to form titanium oxide, lithium boron oxide, and lithium chloride. The resulting adiabatic flame temperature is approximately 6500 to 7000 degrees Fahrenheit and the exothermic reaction releases about 2300 calories per gram. In addition, due to the high temperature generated, reaction products include biocide agents such as monatomic chlorine and fluorine along with hydrochloric and hydrofluoric acids. Each of the cartridges 110 will include a fuze (not shown) to initiate each cartridge 110 after expulsion from the warhead.

The plurality of bomblets 112 are designed to penetrate tanks and containers of chemical and biological agents so the agents spill out of the containers. This way the high-temperature incendiary fill 108 may defeat them as discussed above. Any number of bomblets 112 may be used and are selectable by one skilled in the art dependent upon the target. A preferred range for the number of bomblets for a BLU-109 warhead is from about five to ten. The function of the bomblets 112 is to open a a suffient number of biological or chemical agent storage tanks in a "limited damage" approach where the bomblets 112 will not, in general, open and release more bioloical agent or chemical agent than the weapon can destory through the action of the heat and release of chlorine, iodine or fluorine biocides released through the reaction. The invention does not intend to release more biological or chemical agents than it can destroy as part of a design philosophy which is intended to limit collateral damage. Collateral damage is the unintended or intended release of viable biological or chemical agent from the target in such a way that the loss of life of noncombatants results. FIG. 4*a* shows one preferred embodiment of the bomblets 112. The bomblets comprise copper plates 430 having a rubber backing 432 with a high explosive material 434 placed against the rubber backing 432. The high explosive material 434 may be selected by one skilled in the art. Some examples of preferred high explosive materials 434 include C-4 or RDX or HMX based fills. The bomblets 112 will be attached to a thermal detonator (not shown) that initiates the bomblets 112 when the reaction temperature of the high-temperature incendiary fill 108 reaches a certain point selected by one skilled in the art. Preferred temperatures to activate the thermal detonator range from about 300 to degrees Fahrenheit to about 500 degrees Fahrenheit.

Figure 4B:
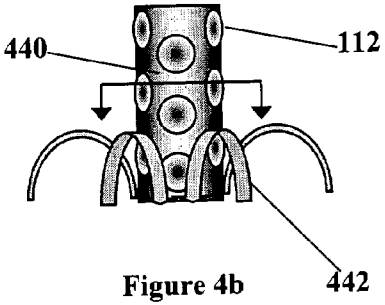
FIG. 4*b* shows a side view of the bomblet mounting mechanism of an embodiment of the invention.
Figure 4A:
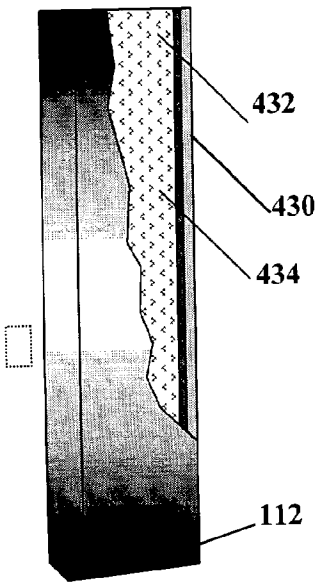
FIG. 4*a* shows a cut-away view of an embodiment of a bomblet of the invention.
Figure 4C:
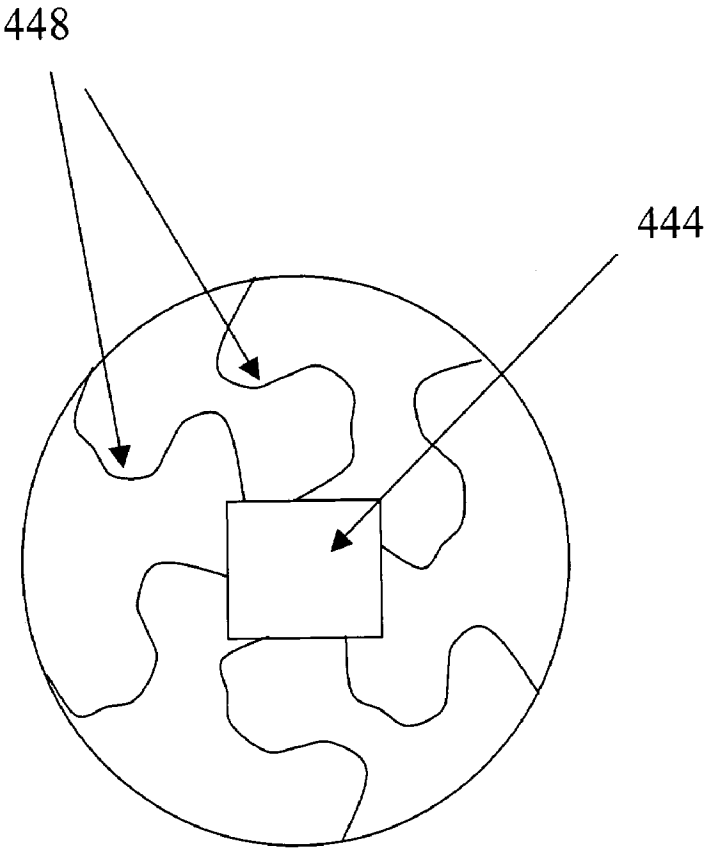
FIG. 4*c* shows a top view of the mounting mechanism of FIG. 4*b*.

FIGS. 4*b* and 4*c* show how the plurality of bomblets 112 may be mounted within the warhead. The bomblets copper plates 112 are mounted upon a hollow tube or in a hex 440. Other configurations could employ six faced cubes, eight faced octahedron or twelve faced dodecahedron. Fuze lines 448 run from each bomblet 112 and are bundled within the hollow tube 440 with the thermal detonator 444. If desired, a self-righting mechanism 442, similar to those used for land mines, may also be employed. The self-righting mechanism 442 shown comprises a plurality of steel strips that act similar to springs in order to assist the system to righting its orientation. In operation, when the high explosive material 434 is initiated, the copper plate 112 is driven forward, creating a concave shape, at velocities great enough to create holes in metal tanks and containers. The system may also contain a layer of material capable of generating a biocide immediately upon ejection from the warhead prior to the ejection and burn of the cartridge systems. This material, ejected with the bomblets 112, would contain a material capable of generating a large amount of a biocide such a chlorine. The preferred material is calcium hypochlorite dihydrate powder. Other materials which could be used for this purpose include lithium hypochlorite and sodium hyperchlorite. The purpose of ejecting this material is to generate a lethal environment for biological agents which might be released in the event that the bomb, in penetrating into the target, impacts a biological agent tank.

The biocide agent 118 is added to the back of the payload to address a situation where the warhead 100 penetrates a container containing a biological agent before the high temperature incendiary fill 108 can be deployed to provide a biocide as described above. The biocide agent 118 may comprise any substance capable of neutralizing a biological agent and may be selected by one skilled in the art. Examples of preferred biocide agents 118 include those mentioned above such as halogenated compounds including chlorine, fluorine, or their acid derivatives.

The separation system 114 should be capable of separating the tail section 102 from the payload section 104 so that the high-temperature incendiary fill 108 and the bomblets 112 may be expelled from the warhead to interact with the target. While a myriad of systems may be selected by one skilled in the art to accomplish this task, one preferred separation system 114, depicted in FIGS. 1 and 2, comprises an explosive charge 130, which can be, for example, a linear shaped charge or an explosive ribbon charge cutting system, located at the connection point of the tail section 102 and the payload section 104. A fuze (not shown) is used to initiate the explosive charge 130. This fuze is preferably a time delay or void sensing fuze. The fuze will sense the impact through a structure, such as a roof of a chemical or biological agent manufacturing plant, and initiate the explosive charge 130. The tail section 102 is shown attached to the payload section 104 through a threads 134, a retaining ring 136 and an aft closure 138.

The expulsion system 116 should eject the high-temperature incendiary fill 108 and bomblets 112 after the separation of the tail section 102 from the payload section 104. One embodiment of the expulsion system is shown in FIG. 1. The expulsion system 116 comprises two to four explosive charges 150 related to each other's mass on a base-two number system. For example, if M is the mass of the first explosive charge 150, then the mass of the three explosive charges 150 would be 2M, 4M, and 8M respectively. By combining the initiating sequence of these explosive charges 150, 15 different explosive charge forces may be selected by the user of the system (from M through 15M based upon the above example). Therefore, 15 different ejection velocities may be selected. A fuze and detonator system 152 is used to initiate the explosive charges 150 in the selected sequence. A controller system 154 is used in order to communicate to the fuze and detonator system 152 in what sequence the explosive charges 150 should be initiated. The controller system 154 may comprise a high speed comparator array with high speed multiplexer and output to the fuze and detonator system 152. The controller system 154 obtains its data from a velocity data detector 156. The velocity data detector 156 may comprise a piezo film accelerometer in order to obtain velocity data on the warhead and be incorporated into the controller system 154. In operation, the velocity data detector 156 obtains velocity data and sends the data to the controller system 154. The controller system sends the initation sequence to the fuze and detonator system 152, which in turn initiates the explosive charges 150. The preferred velocity selected to eject the payload should be approximately equal to or slightly greater than the forward velocity of the warhead obtained from the velocity data detector 156. U.S. Pat. No. 5,456,429 discloses thruster concepts employing base 2, base 2 and, in general, base M thruster for providing variable thrust or force. This patent, which is incorporated herein, also discloses the use of the base 2, base 3 and base N concepts for thrusters. The patent also discloses other approaches which may be employed or adapted to provide a programmable ejection force for the present invention as discussed herein. In operation, when the charges 150 are initiated, pressure from the explosion pushes the plate 158, forcing the payload from the payload section 104 of the warhead 100.

An operational diagram of the system is shown in FIG. 3. The warhead 100 of the present invention described above is dropped from an aircraft 360. GPS satellites 362 send information to the guidance system 306 to guide the warhead 100 to the target (normally a structure housing tanks and/or containers of chemical and/or biological agents). Upon impacting the target, the separation system 114 separates the tail section 102 from the payload section 104. In turn, the expulsion system 116 expels the high-temperature incendiary fill 108 and the bomblets 112 from the warhead 100. The bomblets 112 would then penetrate the tanks and/or containers as described above and the high-temperature incendiary fill would destroy the contents of the tanks and/or containers while minimizing dispersal of said contents.

What is described are specific examples of many possible variations on the same invention and are not intended in a limiting sense. The claimed invention can be practiced using other variations not specifically described above.

What is claimed is:

1. A weapon system for destroying chemical and biological agents within a structure, comprising:

a kinetic energy penetrator warhead comprising a tail section and a payload section;

a plurality of bomblets located in the payload section;

a high-temperature incendiary fill situated within a plurality of containers located in the payload section;

a guidance system to guide the weapon system to a specific target;

a separation system that separates the tail section from the payload section; and, an expulsion system comprising a plurality of energetic charges, said plurality of energetic charges eject the plurality of bomblets and said plurality of containers containing the high-temperature incendiary fill, wherein the plurality of bomblets penetrate tanks containing at least one of chemical and biological agents allowing the high-temperature incendiary fill to react with said at least one of chemical and biological agents to destroy and minimize dispersal of said at least one of chemical and biological agents.

2. The weapon system of claim 1, further comprising a layer of material capable of generating a biocide, said layer of material is situated with said plurality of bomblets and ejected from the weapon.

3. The weapon system of claim 1, wherein the high-temperature incendiary fill undergoes a single stage reaction releasing heat and a biocide.

4. The weapon system of claim 1, wherein the high temperature incendiary fill undergoes a two stage reaction, a first stage reaction comprising an intermetallic reaction or thermal reaction producing heat and a second stage reaction comprising a reaction producing heat and a biocide.

5. The weapon system of claim 4, wherein high-temperature incendiary fill comprises-a reactive material of titanium; a second reactive material of boron; and, an oxidizer of lithium perchlorate.

6. The weapon system of claim 1, wherein the high temperature incendiary fill produces a biocide selected from the group including halogenated compounds.

7. The weapon system of claim 1, wherein high-temperature incendiary fill comprises a reactive material of titanium; and, a second reactive material of boron.

8. The weapon system of claim 1, wherein the high temperature incendiary fill comprises at least one of metal chlorides, iodides, and fluorides.

9. The weapon system of claim 1, wherein the high temperature incendiary fill at least one of metal chlorides, iodides, and fluorides.

10. The weapon system of claim 1, further comprising a biocide agent placed proximate to the separation system, wherein the biocide agent deploys prior to the high-temperature incendiary fill.

11. The weapon system according to claim 1, wherein said plurality of containers are situated intermediate said expulsion system and said tail section.

12. The weapon system according to claim 1, wherein said plurality of containers comprise a plurality of cartridges, and wherein said plurality of bomblets are situated between said plurality of cartridges and said separation system.

13. The weapon system according to claim 1, wherein said plurality of bomblets are placed in front of a biocide.

14. The weapon system according to claim 1, wherein said high-temperature incendiary fill is situated intermediate said expulsion system and said tail section.

15. The weapon system according to claim 1, wherein said expulsion system is located within said payload section.

16. The weapons system according to claim 1, wherein said kinetic energy penetrator warhead comprises a front portion, said expulsion system is located within said front portion.

17. The weapons system according to claim 1, wherein said kinetic energy penetrator warhead comprises a guidance system.

18. The weapons system according to claim 1, wherein said high-temperature incendiary fill comprises an intermetallic composition, said intermetallic composition generates a thermal impulse comprising a maximum temperature in a range from about 750 degrees F. to 1,500 degrees F.

19. The weapons system according to claim 1, wherein said high-temperature incendiary fill comprises an intermetallic composition, said intermetallic composition generates a thermal impulse burning rate of at least 400 degrees F. for at least several minutes.

20. The weapons system according to claim 1, wherein said high-temperature incendiary fill comprises an intermetallic composition, said intermetallic composition generates a thermal impulse along with a low-overpressure in a range of 0.2 to 0.5 psi.

21. The weapons system according to claim 1, wherein said plurality of containers each comprise an intermetallic center.

22. The weapons system according to claim 1, wherein said plurality of bomblets comprise a predetermined number of bomblets from about five to ten bomblets.

23. The weapons system according to claim 1, wherein said payload section comprises a back portion comprising a biocide agent.

24. The weapons system according to claim 1, wherein said plurality of energetic charges comprises a predetermined number of energetic charges from two to four energetic charges.

25. The weapons system according to claim 1, wherein said expulsion system comprises a controller system, a velocity data detector and a moveable plate.

26. The weapons system according to claim 1, wherein said plurality of bomblets are thermally activated by a reaction temperature of said high-temperature incendiary fill.

27. A weapon system for destroying chemical and biological agents, comprising:

a kinetic energy penetrator warhead comprising a tail section and a payload section;

a plurality of bomblets located in the payload section:

a high-temperature incendiary fill located in the payload section;

a guidance system to guide the weapon system to a specific target;

a separation system that separates the tail section from the payload section; and, an expulsion system that ejects the plurality of bomblets and the high-temperature incendiary fill, wherein the plurality of bomblets penetrate structures containing at least one of chemical and biological agents and allow the high-temperature incendiary fill to react and destroy at least one of the chemical and biological agents with minimal dispersion, and wherein the high temperature incendiary fill comprises wicking fibers to wick up pooled chemical and biological agents.

28. The weapon system of claim 27, wherein the high temperature incendiary fill reacts over a period of time of about greater than 1 minute.

29. The weapon system of claim 27, further comprising a plurality of cartridges within the payload section and each housing the high-temperature incendiary fill.

30. The weapon system of 27, wherein the separation system comprises a linear shaped charge cutting system.

31. The weapon system of 27, wherein the separation system comprises an explosive ribbon charge cutting system.

32. The weapon system of claim 27, wherein the bomblets comprise a copper plate; explosive material on a side of the copper plate; and, a detonator to initiate the explosive material.

33. The weapon system of claim 32, wherein the detonator initiates the explosive material when exposed to a temperature of at least approximately 500 degrees F.

34. The weapon system of claim 27, wherein the expulsion system comprises a plurality of explosive charges that, when initiated, provide a plurality of ejection velocities to a payload.

35. The weapon system of claim 27, wherein the expulsion system comprises a velocity module to determine a forward velocity of the warhead and ejects the payload at least approximately equal to the forward velocity.

36. A method for destroying and minimizing dispersal of chemical and biological agents within a structure, comprising the steps of:

dropping a weapon system from an aircraft comprising a kinetic energy penetrator warhead comprising a tail section and a payload section, a plurality of bomblets located in the payload section, a high-temperature incendiary fill within a plurality of containers located in the payload section, a guidance system to guide the weapon system to a specific target, separation system that separates the tail section from the payload section, and, an expulsion system comprising a plurality of energetic charges, said energetic charges eject the plurality of bomblets, and said plurality of containers containing the high-temperature incendiary fill, wherein the plurality of bomblets penetrate tanks containing at least one of chemical and biological agents allowing the high-temperature incendiary fill to react with said at least one of chemical and biological agents to destroy and minimize dispersal of said at least one of chemical and biological agents;

guiding the weapon system to the structure; and, initiating the weapon system upon impact with the structure.

* * * * *